United States Patent [19]

Stoody

[11] 4,441,632

[45] Apr. 10, 1984

[54] SOFT SHELL AEROSOL DISPENSER UNIT

[76] Inventor: William R. Stoody, 8659 Summerdale Rd., San Diego, Calif. 92126

[21] Appl. No.: 326,667

[22] Filed: Dec. 3, 1981

[51] Int. Cl.[3] ..... B67D 5/56; B65D 83/06

[52] U.S. Cl. ..... 222/129; 222/399; 222/630; 239/308

[58] Field of Search ..... 222/399, 635, 94, 105, 222/129, 173, 478, 630, 386.5; 239/308, 337

[56] References Cited

U.S. PATENT DOCUMENTS

| | | | |
|---|---|---|---|
| 3,388,838 | 6/1968 | Marchant | 222/399 X |
| 3,409,180 | 11/1968 | Schenk | 222/635 |
| 3,563,419 | 2/1971 | Coerver, Jr. | 222/635 |
| 3,583,606 | 6/1971 | Ewald | 222/402.18 |
| 3,615,042 | 10/1971 | Marand | 222/399 X |
| 3,669,313 | 6/1972 | Marand et al. | 222/635 X |
| 3,989,165 | 11/1976 | Shaw et al. | 222/635 X |
| 4,062,475 | 12/1977 | Harris et al. | 222/386.5 |

*Primary Examiner*—Randolph Reese
*Assistant Examiner*—Russell D. Stormer

[57] ABSTRACT

A barrier type aerosol dispenser, wherein a product fluid is separately stored at atmospheric pressure within a primary outer container which is essentially a pliable bottle of almost any desirable shape, including that of a thin wall bag. A motivating gas vessel, containing propellant fluid and including a self-cleaning ejector type valve mechanism, is mounted in the fill opening of the primary container and suspended within the product fluid space thereof. The valve mechanism is adapted to initiate outward flow of propellant to motivate discharge flow of product fluid, and a conduit depending from the valve mechanism is adapted to facilitate separate passage flow of the product fluid through the propellant space of the motivating gas vessel.

6 Claims, 11 Drawing Figures

SOFT SHELL AEROSOL DISPENSER UNIT

RELATED APPLICATIONS

The applicant's related co-pending application are: Ser. Nos. 254,927 filed Apr. 16, 1981, 266,747 filed May 26, 1981, and (pending) filed on or about Nov. 23, 1981.

BACKGROUND OF THE INVENTION

The present invention relates to a novel dispenser for separately storing fluids; which has an outer container that can be a pliable bag or bottle of an economical polymeric substance formed in almost any desirable shape; and wherein product fluid at atmospheric pressure is stored externally of a pressure resistant inner container which contains propellant fluid.

Heretofore, aerosol dispensers capable of internally storing fluids separately have included pliable inner containers within pressure resistant outer containers. The inner containers are generally considered to be of a polymeric substance having enough permeability to the propellant to eventually mix the propellant with the product fluid. Inner containers that are compatible with the contents, and essentially impermeable to the propellant impose limitations and penalties that negate their merits; usually they require costly preassembly within rigid outer containers by the outer container manufacturers or they are limited in size for insertability through the universal size, one inch diameter fill opening of the containers; they require unorthodox filling and pressurizing methods; and because of their requirement for specialized impermeable material, their manufacturing cost is excessive for aerosols.

SUMMARY OF THE INVENTION

It is the object of the present invention to provide an aerosol dispenser, wherein product fluid is stored at atmospheric pressure externally of a pressure resistant inner vessel.

It is another object to provide a pliable outer primary container for said dispenser.

Another object is to provide a means for maintaining ambient atmospheric pressure within the primary container.

Another object is to provide closure means for the dispenser.

A further object is to utilize discharge flow of propellant to provide the means for dispensing product fluid.

A still further object is to provide an economical handling shroud for use with a pliable bag primary outer container.

These and other objects and advantages will be seen from the following specification and claims in conjunction with the appended drawings.

DETAILED DESCRIPTION

Specific terminology resorted to in describing the illustrative embodiments of the invention is not intended to be limiting. It is understood that this is for clarity and includes all technical equivalents which function in a similar manner to accomplish a similar purpose or results.

Figure 1:
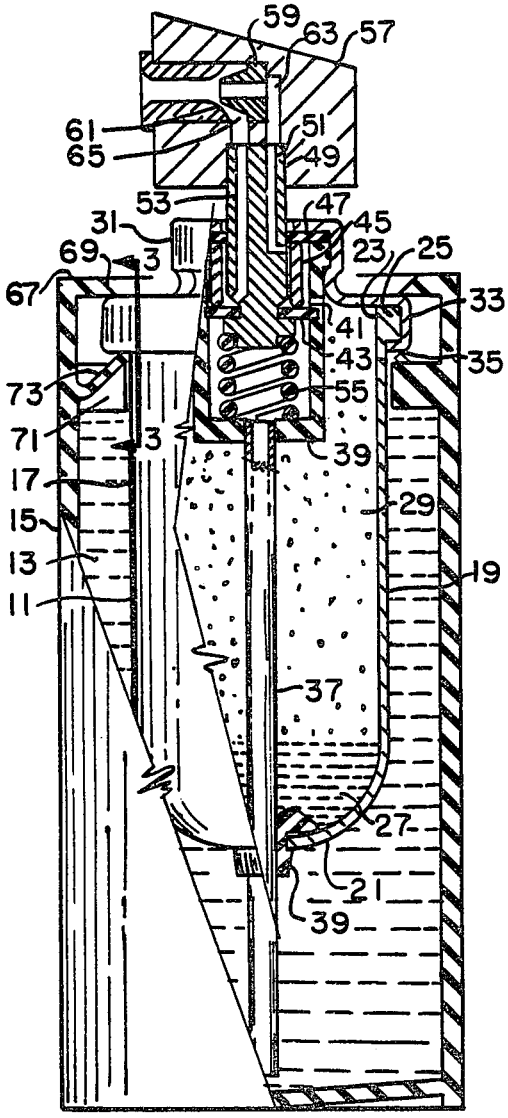
FIG. 1 is a view of the present invention with walls broken away to expose internal features.

In the embodiment shown in FIG. 1, a self-contained pressurized motivating gas vessel 11 is suspended within a product fluid 13 is disposed at atmospheric pressure within a pliable primary outer container, bottle 15, which can be of any suitable shape.

Vessel 11 includes a pressure resistant container 17 having a circumferential wall 19, bottom 21, and an annular open end 23 that has a peripheral annular bead 25. Disposed within vessel 11 is a liquefied pressurizing fluid 27 and pressurizing fluid vapor 29. Closure of vessel 11 open end 23 is provided by a valve mechanism 31 mounting and unifier member 33 which is generally referred to as a valve cup. Said valve cup 33 sealingly overlies open end 23 and a portion of the valve cup is securingly turned under bead 25 at designation 35. Depending from valve mechanism 31 is a conduit 37 which provides a separate passageway means for flow of products fluid 13 into said valve mechanism 31 for subsequent discharge. Conduit 37 extends through a sealing grommet 39, that protrudes through bottom 21, to receive said product fluid.

Valve mechanism 31 is a self-cleaning ejector type dispensing device that is adapted to internally maintain separation of pressurizing fluid and product fluid, and utilize discharge flow of pressurizing fluid to create a vacuum pressure to draw and discharge product fluid. Valve mechanism 31 comprises: said valve cup 33; housing 39 which has a pressurizing fluid passageway orifice 41; barrier gasket 43; valve seat means 45; upper end sealing gasket 47; a resiliently mounted stem member 49 that has a pressurizing fluid discharge passageway 51 which is separated from a product fluid discharge passageway 53 thereof; spring 55 which biases said stem 49 in an uppermost position to effect a normally shut condition of said valve mechanism; and cooperatively coupled with stem 49, an outwardly projecting depressible dispensing head 57 that includes a motive gas nozzle 59, venturi throat 61, motive gas passageway 63, and suction chamber 65. Valve mechanisms of the type briefly described herein are explained in detail in the related applications filed in May and November of 1981.

Valve mechanism 31 is internally separated by barrier gasket 43 that cooperatively engages valve seat 45 and stem 49 to provide separate fluid chambers, and effect operation and non-operation of said valve. When the valve is in a non-operating state, engagement of barrier gasket 43 with respect to valve seat 45 prevents discharge passage of pressurizing fluid into stem passageways 51 and 53, and engagement of said barrier gasket 43 with respect to stem 49 prevents passage of product fluid. In an intermediate operating position, for valve cleaning, barrier 43 is disengaged from valve seat 45 allowing pressurizing fluid vapor discharge flow through both stem passageways 51 and 53, and engagement of barrier 43 with respect to stem 49 continues to prevent discharge flow of product fluid.

When valve mechanism 31 is operated for product fluid discharge, with dispensing head 57 fully depressed, barrier gasket 43 remains disengaged from valve seat 45 allowing continued flow of pressurizing fluid vapor through stem passageway 51, product fluid passageway 53 is protruded through barrier 43 allowing concurrent separate flow of product fluid through stem 49. During product fluid discharge barrier 43 maintains sealing engagement with stem 49 to prevent intermixing of said fluids within said valve housing. The out flow of pressurizing fluid vapor through dispensing head 57 motive gas passageway 63 and motive gas nozzle 59 creates a vacuum pressure as the vapor passes venturi throat 61, the vacuum draws product fluid into suction chamber 65 and therefrom product fluid is expelled with the said vapor.

Figure 3:
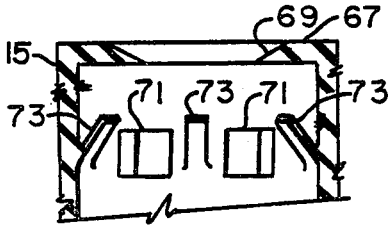
FIG. 3 is a view taken substantially along lines 3—3 of FIG. 1, to illustrate inner container mounting means.

To facilitate use of the said ejector type valve mechanism 31 of vessel 11, a means is required to prevent the creation of a back pressure vacuum in bottle 15, which may be caused by evacuation of product fluid. Pursuant thereto, the upper end of bottle 15 has an annular flange 67 that extends radially inward and includes a downwardly slanting surface that terminates adjacent to the bottom surface of said flange and provides an annular, resilient latching lip 69 which also serves as a fill opening. Internally formed in bottle 15 and spaced below flange 67 are a plurality of shelves that project radially inwards. The shelves, designated 71, are alternated with upwardly slanting resilient tabs 73 that are essentially springs, these features can be seen in FIG. 3.

Figure 2:
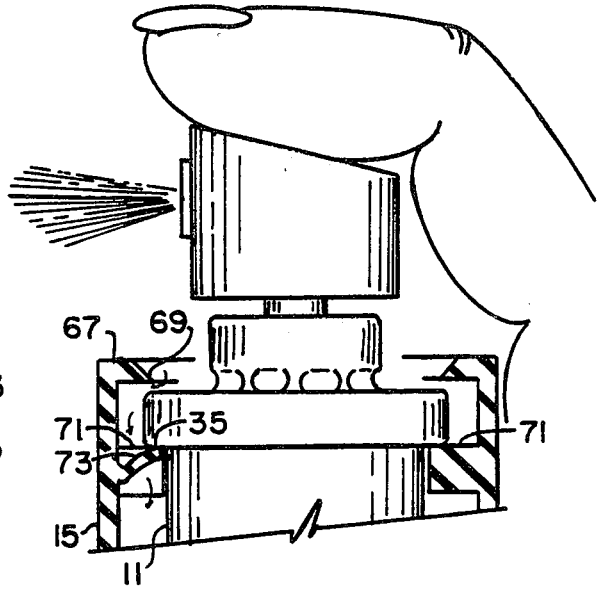
FIG. 2 is a fragmentary sectional view elaborating features for maintaining atmospheric pressure within the outer container.

The resiliency of latching lip 69 allows vessel 11 to be snap-fit mounted in said open end of bottle 15. Tabs 73 are positioned to engage said valve cup 33 at designation 35 and support said vessel 11 biasing the upper surface of valve cup 33, adjacent to its periphery, sealingly against the underside surface of latching lip 69. Shelves 71 are situated to center vessel 11 in said open end of bottle 15, and allow approximately 0.010 inch reciprocative movement of vessel 11 when said dispensing head 57 is depressed for product fluid dispensing as shown in FIG. 2. Tabs 73 deflect in response to operating pressure applied against said dispensing head 57 and allow downward movement of vessel 11. Thus, ambient air can enter bottle 15 when product fluid is being evacuated, preventing said back pressure vacuum, and said bottle is automatically resealed preventing spillage when said product fluid evacuation is halted.

MODIFICATION

Figure 4:
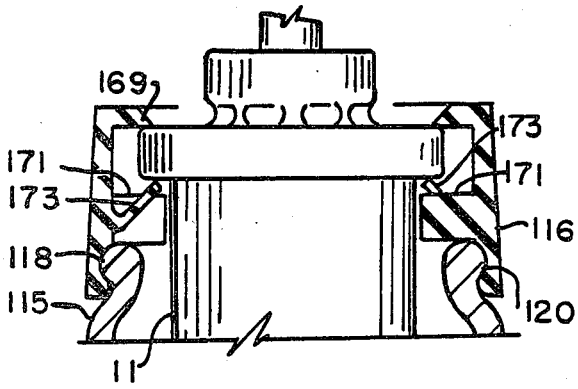
FIG. 4 is a fragmentary sectional view illustrating a modification of the outer container.

FIG. 4 shows a modification that merely demonstrates use of an annular adapter 116 for snap fit mounting, as previously described, of motivating gas vessel 11 within a rigid bottle, designated 115, that has an annular bead 118 formed about its open end. Adapter 116 is considered to be made of a stiff resilient material, such as plastic, and it is provided with an annular latching lip 169, shelves 171, and tabs 173 which are equivalent to previously described latching lip 69, shelves 71, and tabs 73. Additionally adapter 116 is provided with an annular groove 120 internally formed in the lower wall portion thereof for snap-fit mounting engagement with bead 118.

MODIFICATION

Figure 5:
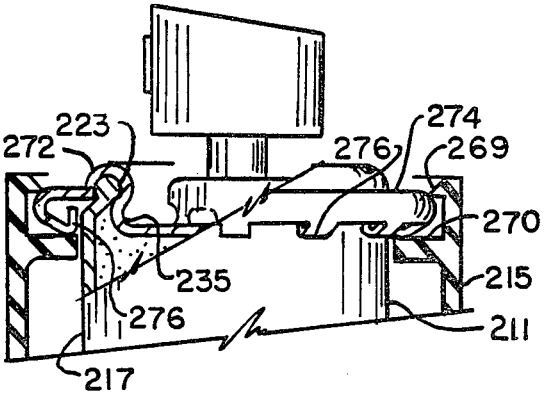
FIG. 5 is a fragmentary sectional view with broken away wall portions to depict a second modification.

FIG. 5 shows a second modification which demonstrates an alternative reciprocative mounting method for motivating gas vessel 211, which is essentially the same as vessel 11, in a pliable bottle designated 215 instead of 15.

Bottle 215 has at its upper end; an annular latching lip 269, which is equivalent to previously said latching lip 69, for snap-fit mounting of vessel 211; and instead of said shelves 71, bottle 215 is provided with an annular support ledge 270 that forms a central opening sized to center vessel 211.

Figure 6:
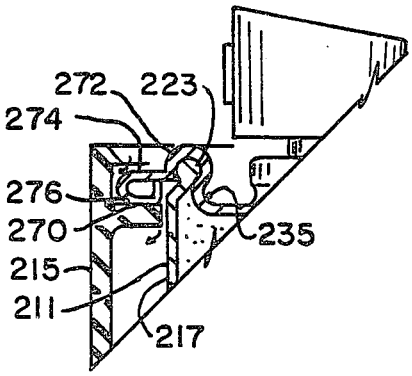
FIG. 6 is a fragmentary sectional view illustrating functional features of the second modification.

Vessel 211 includes a pressure resistant container 217 having an annular fill opening 223 at its upper end, and a valve cup 272 that is clinched at designation 235 to provide closure of vessel 211. Valve cup 272 has an annular peripheral flange 274, and a plurality of spring tabs 276 which are curled inwardly under flange 274 as seen in FIG. 6.

As seen in FIG. 5, tabs 276 are sized to span between lip 269 and ledge 270, and bias vessel 211 upwardly to effect closure engagement of the upper peripheral surface of flange 274 with respect to latching lip 269 when fluid product is not being evacuated. Ends of tabs 276 are spaced from the underside surface of flange 274 to limit tab deflection and reciprocative movement of vessel 211 to approximately 0.010 inch when product fluid is being evacuated. All other functions and features are as described heretofore.

MODIFICATION

Figure 7:
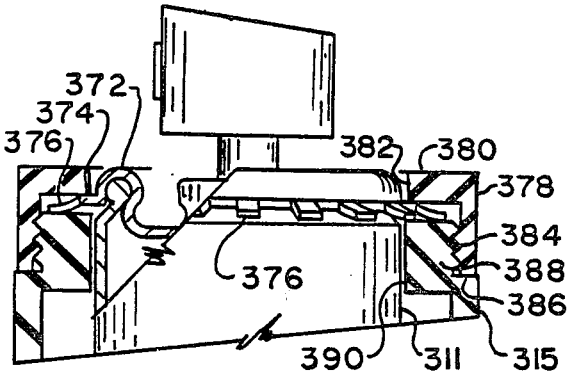
FIG. 7 is another fragmentary sectional view to illustrate a third modification having walls broken away for clarification.

FIG. 7 illustrates a third modification demonstrating still another method of reciprocatively mounting motivating gas vessel in a pliable bottle. Here, vessel 311 is provided in place of previously said vessel 211, and a refillable bottle 315 is provided in place of previously said bottle 215. In addition, in place of latching lip 269, a mounting cap 378 which has a closure end 380 that is provided with a central opening 382 to permit protrusion of the central portion of vessel 311 valve cup designated 372. Cap 378 is also provided with internal threads designated 384, for coupling engagement with bottle 315.

Bottle 315 has an annular shoulder 386 and an externally threaded neck 388 which has a central fill opening 390 that is sized to receive and center vessel 311. Cap 378 is joined to neck 388 and provides a space between the inside surface of closure end 380 and the upper end surface of neck 388, and the bottom surface portion of cap 378, adjacent threads 384, is sealingly closed against shoulder 386.

Vessel 311 is supported on the end surface of neck 388 by a plurality of peripheral spring tabs 376 that slant downward and extend radially outward from an annular flange 374 of valve cup 372. Said tabs 376 are adapted to span between the underside surface of closure end 380 and said end surface of neck 388, and bias vessel 311 upwardly effecting sealing closure of flange 374 with respect to said surface of closure end 380 when product fluid is not being evacuated; and allow approximately 0.010 displacement of vessel 311 for ambient air passage when product fluid is being evacuated. All other functions and features are as described heretofore.

MODIFICATION

Figure 8:
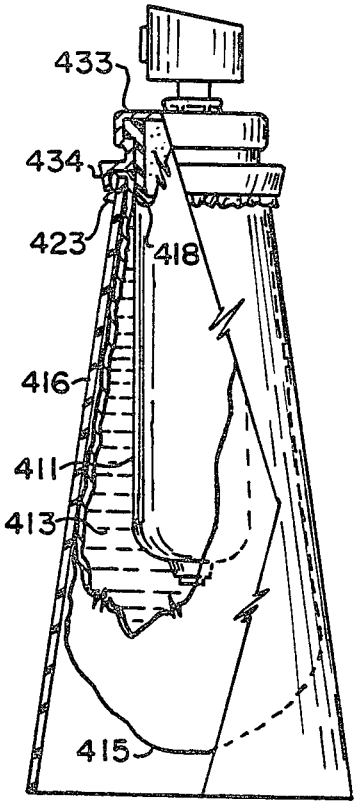
FIG. 8 is a view of a fourth modification wherein the primary outer container is a bag, walls are broken away to expose internal features.

An alternative means for preventing previously said back pressure vacuum is shown in FIG. 8. In this modification a collapsible bag 415, of an impervious pliable material having a fill opening end 423 and containing product fluid now designated 413, is utilized in place of bottle 15 containing product fluid 13 shown in FIG. 1. Bag 415 is particularly suited for storage or product fluid that would be adversely affected by admittance of ambient air, the use of bag 415 eliminates the need for ambient air to maintain atmospheric pressure within the bag to prevent said back pressure vacuum. When product fluid is discharged, bag 415 merely collapses occupying the space vacated as a result of the discharge flow of product fluid. The collapsing feature of bag 415 also allows the fill opening end 423 to be permanently sealed.

To accommodate use of bag 415, vessel 411 which is essentially the same as vessel 11, has a modified valve cup 433 that includes all of the functions and features of valve cup 33 and in addition it is adapted at designation 434 to overlie opening end of bag 415 and provide an annular sealing engagement thereabout.

Also to facilitate use of bag 415 a hollow conical shape shroud 416, which is open at both ends, is provided for handling ease. Shroud 416 can be made of any reasonably stiff material including cardboard. The smaller open end of the shroud is sized to accommodate bag 415 and provide a snug relationship of vessel 411 and bag 415 at designation 418.

In an assembly sequence; bag 415 is placed within shroud 416 and fill opening end 423 is folded outwardly over said small end of said shroud; product fluid 413 is disposed in bag 415; vessel 411 is inserted into bag 415 and suspended within product fluid therein; thereafter, at designation 434, valve cup 433 is compressed to effect annular sealing and clamping engagement of shroud 416 and bag 415 with respect to vessel 411 at designation 418.

All other functions and features are as described heretofore in reference to FIG. 1.

Figure 9:
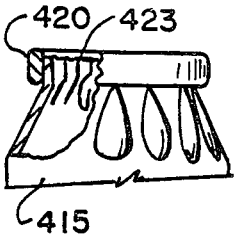
FIGS. 9, 10 and 11 are fragmentary views having wall portions broken away, illustrating secondary modifications of the fourth modification.
Figure 10:
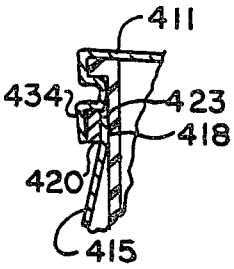
Figure 11:
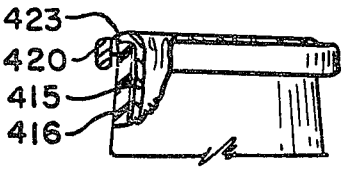

FIG. 9, FIG. 10 and FIG. 11 demonstrate one of many possible modification that are envisioned for bag 415. Shown in FIG. 9, fill opening end 423 of bag 415 is gathered and affixed within an annular stiffening bead 420 that is sized to provide a snug fit relationship of bag 415 with respect to vessel 411 without the inclusion of said shroud, as seen in FIG. 10. In assembly with vessel 411, valve cup 433 is compressed against bead 420 to effect an annular sealing and clamping engagement of bag 415 with respect to vessel 411 at said designation 418. Affixing of bag 415 within bead 420 can easily be accomplished by conventional heat bonding processes.

In addition as seen in FIG. 11, bead 420 can be sized to allow use of shroud 416 in a manner as described heretofore. By inverting said bag 415, as seen in FIG. 11, with respect to bead 420, fill opening end 423 can be adapted as a means for supporting bag 415 within the said small end of shroud 416. This can be especially convenient for disposing product fluid in said bag.

It is thought that the invention and its advantages will be understood from the foregoing description, and it is apparent that various changes may be made in the form, construction and arrangement of parts without departing from the spirit and scope of the invention or sacrificing its material advantages, the form hereinbefore described and illustrated in the drawings being merely a preferred embodiment thereof.

Having described my invention, reference should now be had to the following claims.

I claim:

1. A self-contained aerosol type dispenser comprising a container, wherein atmospheric pressure is maintained, holding a product fluid to be dispensed;

a motivating gas vessel suspended within said container;

said vessel containing pressurizing fluid, and including an operable valve means for dispensing said product fluid;

and passageway means for separate flow of said product fluid into said valve means;

said valve means being adapted to initiate discharge flow of said pressurizing fluid, and utilize said flow to effect discharge flow of said product fluid;

said vessel mounted in cooperative valvular engagement with said container for controllable admittance of ambient air into the container;

said vessel resiliently mounted and normally biased to provide closure of said container;

said vessel being reciprocatively movable to allow air entrance into said container when said valve is operated for discharge of product fluid.

2. In the invention of claim 1, said container being a pliable bottle having a fill opening end adapted to provide resilient mounting means for said vessel.

3. In the invention of claim 2, said vessel being mounted in a snap-fit manner within said fill opening end.

4. In the invention of claim 1, said vessel including resilient mounting means.

5. In combination with the invention of claim 1, a cap provided therewith for mounting of said vessel.

6. In the invention of claim 1, said container being a rigid bottle having a fill opening end adapted to provide resilient mounting means for said vessel.

* * * * *